US005240016A

United States Patent [19]

Nichols et al.

[11] Patent Number: 5,240,016

[45] Date of Patent: Aug. 31, 1993

[54] THERMALLY RELEASABLE GEL-BASED FLAVOR SOURCE FOR SMOKING ARTICLES

[75] Inventors: Walter A. Nichols; Pamela D. Lieberman; Mary E. Toerne, all of Richmond, Va.

[73] Assignee: Philip Morris Incorporated, New York, N.Y.

[21] Appl. No.: 688,154

[22] Filed: Apr. 19, 1991

[51] Int. Cl.[5] ..... A24B 15/14

[52] U.S. Cl. ..... 131/335; 131/194; 131/337; 131/352; 131/275

[58] Field of Search ..... 131/335, 337, 352, 274, 131/275, 276, 194

[56] References Cited

U.S. PATENT DOCUMENTS

| | | | |
|---|---|---|---|
| 2,445,476 | 7/1948 | Folkman . | |
| 3,098,492 | 7/1963 | Wurzburg et al. . | |
| 3,240,212 | 3/1966 | Royster | 131/337 |
| 3,334,636 | 8/1967 | Zuber | 131/337 |
| 3,528,434 | 9/1970 | Halter et al. . | |
| 3,550,598 | 12/1970 | McGlumphy | 131/337 |
| 4,347,855 | 9/1982 | Lanzillotti et al. . | |
| 4,510,950 | 4/1985 | Keritsis et al. . | |
| 4,596,259 | 6/1986 | White et al. . | |
| 4,632,131 | 12/1986 | Burnett et al. . | |
| 4,874,000 | 10/1989 | Tamol et al. . | |
| 4,880,018 | 11/1989 | Graves, Jr. et al. . | |
| 4,893,639 | 1/1990 | White . | |
| 4,917,161 | 4/1990 | Townend | 131/352 |
| 4,924,887 | 5/1990 | Raker et al. . | |
| 4,981,522 | 1/1991 | Nichols et al. . | |
| 5,092,352 | 3/1992 | Sprinkle | 131/352 |

FOREIGN PATENT DOCUMENTS 2028095 3/1980 United Kingdom .

*Primary Examiner*—V. Millin
*Assistant Examiner*—J. Doyle
*Attorney, Agent, or Firm*—David C. Radulescu; Marta E. Gross

[57] ABSTRACT

A flavor source to be used as a thermally releasable flavorant for smoking articles that do not combust tobacco. The flavor source includes tobacco particles, an aerosol precursor that forms an aerosol upon exposure to heat, and a gelling agent that imparts sufficient structural framework for rigidity to the flavor source. The material is mixed, extruded through a die, and cut into the shape of a one-piece flavor source. The flavor source is loaded into a chamber for inclusion in a smoking article as a flavor generator.

30 Claims, 6 Drawing Sheets

THERMALLY RELEASABLE GEL-BASED FLAVOR SOURCE FOR SMOKING ARTICLES

BACKGROUND OF THE INVENTION

This invention relates to a thermally releasable flavor source for use in smoking articles which produce substantially no smoke. More particularly, this invention relates to a gel-based tobacco-containing thermally releasable flavor source that provides the sensations associated with the smoking of tobacco without the burning of tobacco.

It is known to provide a smoking article in which a flavor source of tobacco, or tobacco-derived material, is heated, without combustion of tobacco, to release tobacco flavors without producing all the normal products of tobacco combustion. For example, U.S. Pat. No. 4,991,606, commonly assigned herewith, describes a smoking article having a source of tobacco-derived material in radiative and convective contact with a combustible heat source. A smoker draws heated air through or around the flavor source, releasing tobacco flavors that are drawn into the smoker's mouth.

In the type of smoking articles described above, it is desirable that the flavor source is easy to manufacture and that it can be easily incorporated into a smoking article. Furthermore, the types of constituents that can be incorporated into the flavor source itself should not be limited. The flavor source should be able to contain any material that releases desirable flavors and other compounds when subjected to a heat source, either by way of conduction, convection, or radiation, or a combination of these. The flavors and other compounds should include those associated with tobacco, or tobacco substitutes, as well as other desirable flavors. The flavor source should also be able to contain a large amount of aerosol precursor that forms an aerosol upon being subjected to heat.

There have been various attempts to produce a flavor source which fulfills the above-described requirements and which provides the smoker with the taste and satisfaction that has become expected of a conventional tobacco-burning smoking article. For example, published European patent application No. 0 212 234 by Banerjee et al. describes a flavor source for use in a smoking article that may comprise granules formed from a mixture of thermally stable adsorbent carbon and tobacco. The granules can also be formed from other thermally stable materials such as alumina. The substrates may be formed in a one step process (e.g., as described in U.S. Pat. No. 27,214) in a "Marumerizer"-type machine and are impregnated with aerosol-forming materials and volatile flavoring agents.

Published European patent application 0 254 848 by Banerjee et al. describes a flavor source where the substrate material used as a carrier, e.g., alumina, porous grade or activated carbons, has been treated so that it has a decreased aerosol retentive capacity, and therefore is capable of producing larger quantities of aerosol upon subjecting the flavor source to heat. The improvement in the production of aerosol is achieved by subjecting the granular substrate materials to high-temperature processing and other steps prior to impregnation.

Nichols et al. U.S. Pat. No. 4,981,522, commonly assigned herewith, describes a flavor source comprising a mixture of tobacco particles, an aerosol precursor, and a filler material that absorbs and radiates heat to minimize the likelihood that the flavor material will ignite.

Pellets of the mixture could be formed by extrusion through a die. The amount of aerosol precursor that could be incorporated into the flavor source was indicated to be from about 5 to 35 weight percent.

In prior art articles the amount of aerosol precursor that could be incorporated into the flavor source was limited. It would be desirable to be able to incorporate larger amounts of aerosol precursor and other liquids into the flavor source. Also, as the concentration of these constituents goes up, less heat would be wasted heating a non-aerosol material. Furthermore, the problem of ashing of the flavor source would then inherently be reduced because of the higher concentration levels. Ashing results when liquid is depleted from the part of the flavor source that is closest to the heat source, thereby raising the temperature of this end of the flavor source. Therefore, if the concentration of liquids in the flavor source is increased, this would reduce the possibility of ignition and combustion of the flavor source. Achievement of such a reduction in ashing would also allow the heat source to be positioned closer to the flavor source in a smoking article.

Accordingly, it would be desirable to have a flavor source capable of containing higher concentrations of aerosol precursors and other liquids so as to have the added advantages of reducing the ashing tendency of the prior art smoking articles.

In prior art articles the flavor source was generally comprised of a packed-bed of individual aerosol-generating pellets or particles. This resulted in a smoking article that was comprised of a large number of parts, which renders its manufacture difficult. In particular, the packed bed had to be held in place by a screen-like clip which allowed the aerosol to pass through it into an expansion chamber.

Accordingly, it would be desirable to eliminate the need for a packed-bed of individual pellets or particles as well as the manufacturing complexity associated with such a packed bed. Furthermore, it would be desirable to have a one-piece flavor source which can simply be inserted into a smoking article without the need for any screen-like clips.

Such a one-piece flavor source would also have the added advantage of reducing inconsistencies in flavor delivery to the user. With packed-bed flavor sources the consistency in flavor delivery depends upon the consistency in flavor bed loading, in addition to the consistency of the physical and chemical characteristics of the individual pellets or particles. It would be desirable to be able to provide a one-piece flavor source so as to improve the consistency of flavor delivery to the user.

SUMMARY OF THE INVENTION

It is an object of this invention to provide a flavor source where the amount of aerosol precursor and other liquids incorporated into it can be increased in comparison to prior art sources.

It is a further object of this invention to provide a flavor source which does not undergo ashing during use.

It is an additional object of this invention to provide a flavor source that can be incorporated into a smoking article in closer proximity to the heat source.

It is a further object of this invention to provide a flavor source which facilitates the design and manufacturing of smoking articles.

It is also an object of this invention to provide a flavor source capable of delivering a consistent level of flavor to the user.

In accordance with this invention, a flavor source is provided. The flavor source is formed from a mixture of a gelling agent with an aerosol precursor, tobacco particles, water, and other flavor agents. The gelling agent allows higher concentrations of aerosol precursor and other liquids, to be incorporated into the flavor source in comparison to prior art sources.

In a preferred embodiment the gelling agent comprises agar, pectin, gellan, gelatin or carrageenan. Furthermore, in a preferred embodiment of the present invention, the mixture is formed into a shape which comprises a central cylinder from which a plurality of vanes radiate outward in a spoke-like fashion.

BRIEF DESCRIPTION OF THE DRAWINGS

The above and other objectives and advantages of the invention will be apparent upon consideration of the following detailed description, taken in conjunction with the accompanying drawings in which like characters refer to like parts throughout, and in which:

FIG. 1(*b*) is a perspective view of an "eight-spoke-wheel" flavor source extruded out of the die of FIG. 1(*a*);

DETAILED DESCRIPTION OF THE INVENTION

The flavor source of this invention comprises a thermally releasable flavorant material which can be produced by an extrusion process that provides for the homogeneous mixture of the components and a substantially uniformly sized and shaped end product.

The tobacco material may be comminuted tobacco selected from the group consisting of bright, burley, oriental, sun-cured, air-cured bright and mixtures thereof, reconstituted tobacco, comminuted stems or tobacco dust or fines. The tobacco may have been previously subjected to a stiffening or expansion process to increase its filling power, or to other conventional tobacco treatment processes, for example, to reduce the alkaloid or nicotine content of the tobacco. The flavor source mixture comprises about 0 to about 50 percent by weight tobacco, preferably from about 25 to about 45 percent (all percentages and ratios used herein are by weight unless otherwise noted).

Figure 1A:
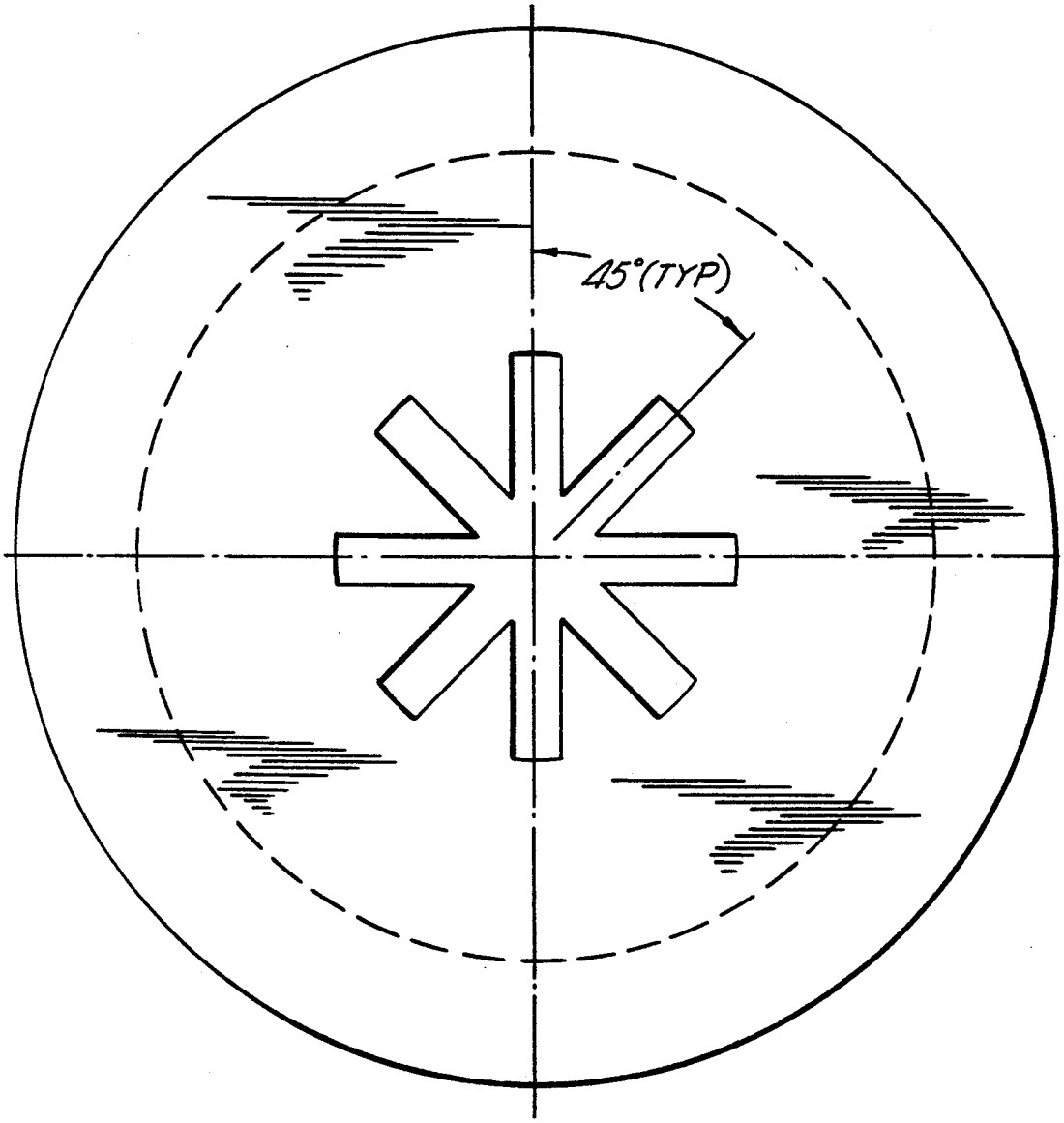
FIG. 1(*a*) is a front view of an "eight-spoke-wheel" extrusion die used to form an embodiment of the invention.
Figure 1B:
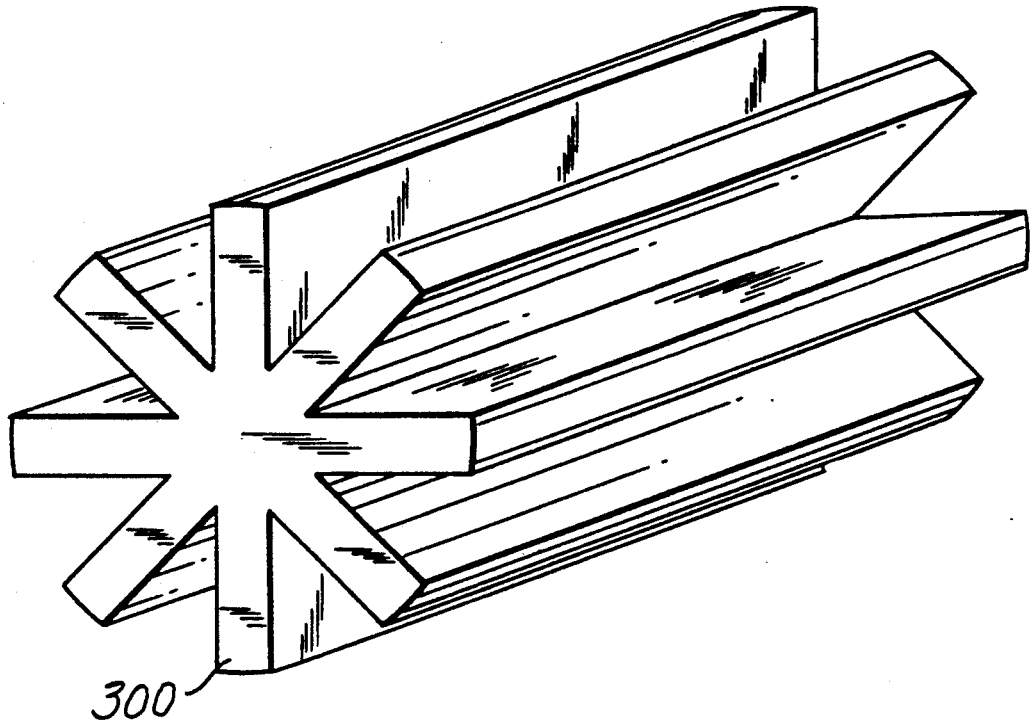
Figure 2:
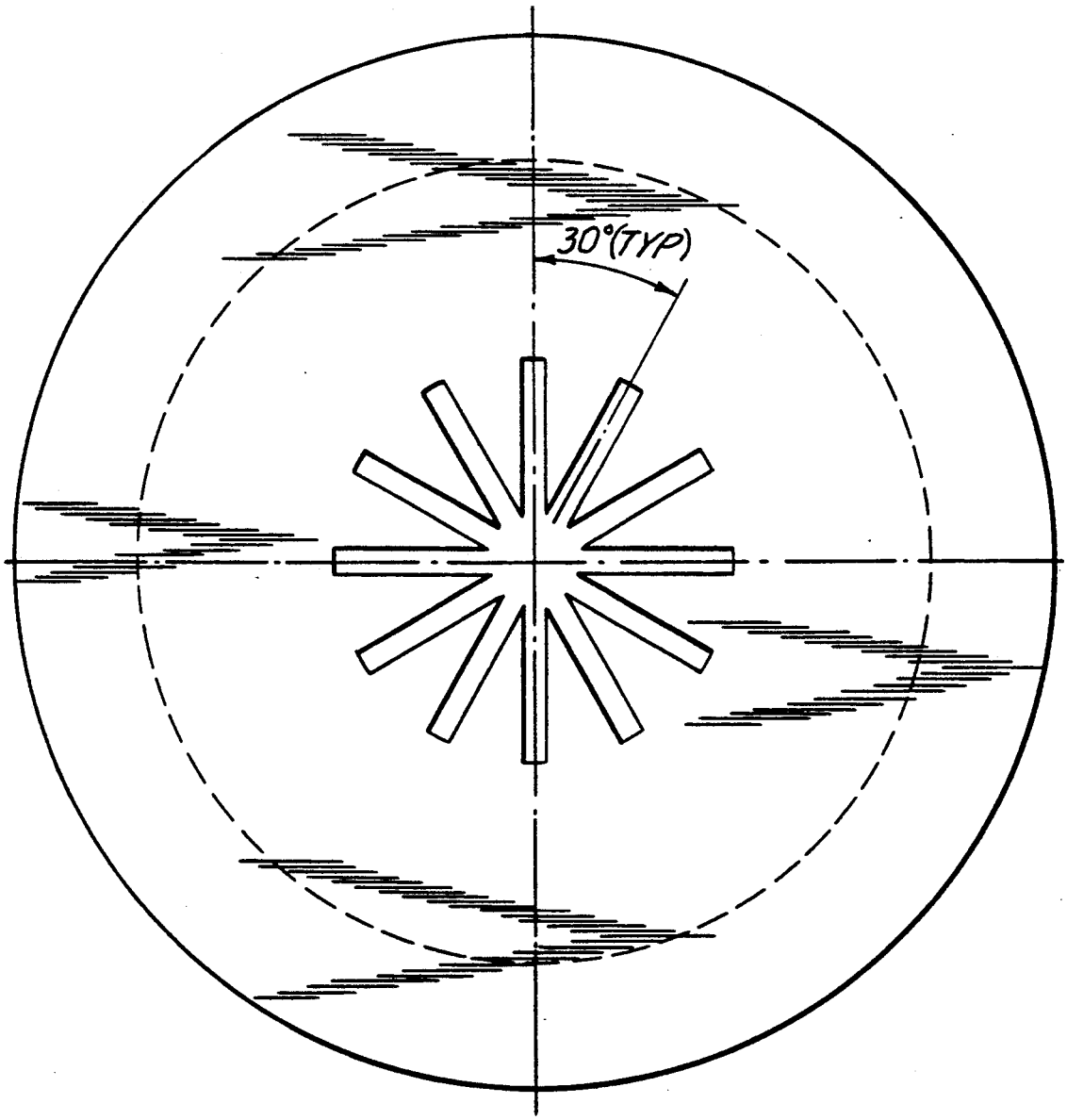
FIG. 2 is a front view of a "Twelve-spoke-wheel" extrusion die used to form an embodiment of the invention.
Figure 3:
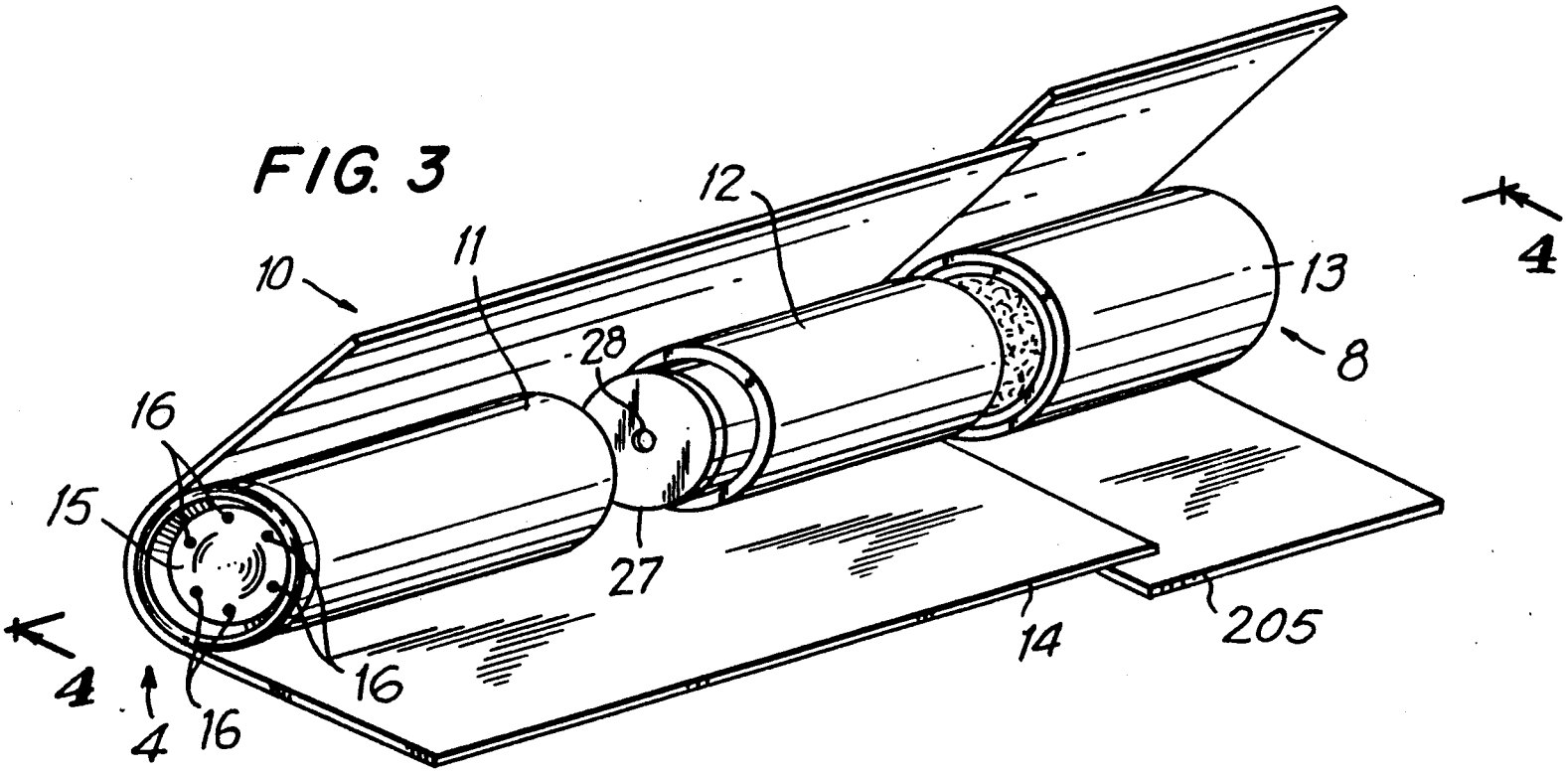
FIG. 3 is an exploded perspective view of an embodiment of a smoking article incorporating the flavor source of the present invention.
Figure 4:
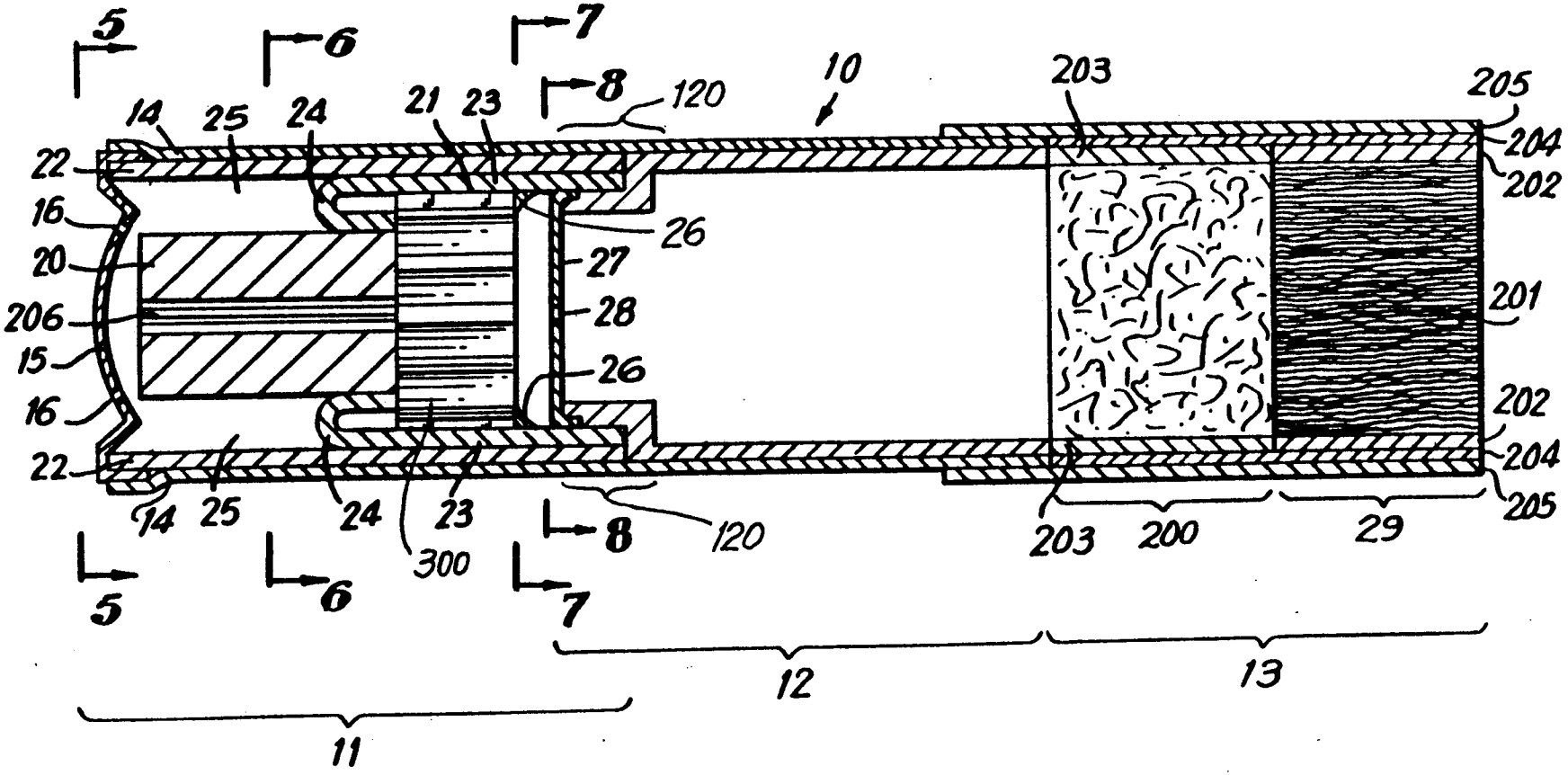
FIG. 4 is a longitudinal cross-sectional view of the smoking article of FIG. 3, taken from line 4—4 of FIG. 3.
Figure 5:
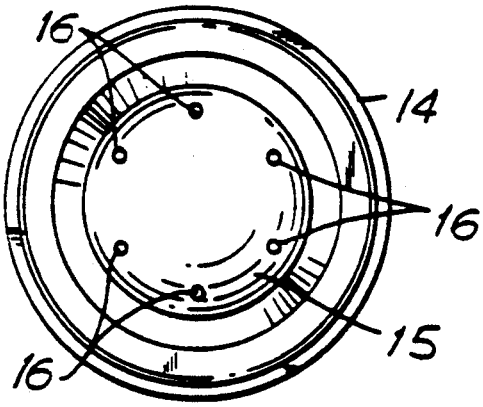
FIG. 5 is an end view of the smoking article of FIGS. 3 and 4, taken from line 5—5 of FIG. 4.
Figure 6:
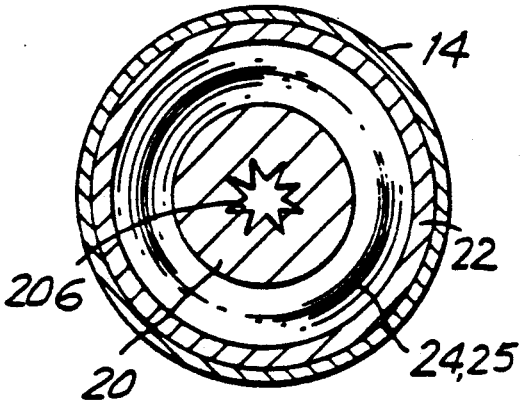
FIG. 6 is a radial cross-sectional view of the smoking article of FIGS. 3–5, taken from line 6—6 of FIG. 4.
Figure 7:
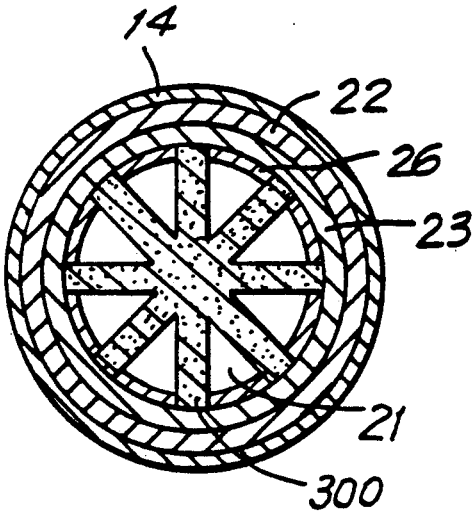
FIG. 7 is a radial cross-sectional view of the smoking article of FIGS. 3–6, taken from line 5—5 of FIG. 4.
Figure 8:
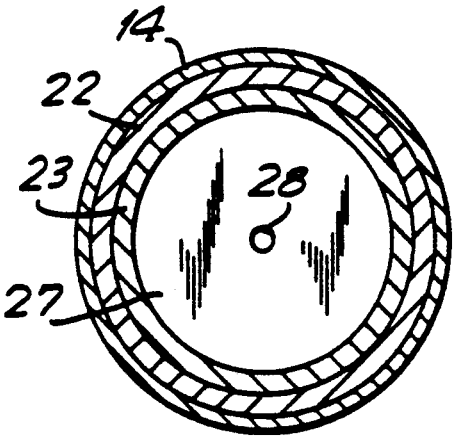
FIG. 8 is a radial cross-sectional view of the smoking article of FIGS. 3–7, taken from line 6—6 of FIG. 4.

Whatever the source of the tobacco particles, the particles employed in the present invention will have a particle size in the range of from about 20 to about 400 mesh (Tyler), preferably with a mesh number in excess of about 100. The particle size of the tobacco impacts the rheological properties of the formulation and the ability to extrude intricate profiles. As the particle size is reduced below about 100 mesh, the consistency of the product improves. A particle size greater than 20 mesh would produce a very grainy, poorly defined profiled extrudant. Of course the quality of the profiled extrudant will depend upon the specific profile of the extrusion die employed. For "spoke wheel" designs, as shown in FIGS. 1 and 2, smaller spoke "widths" require a finer tobacco particle grain size in order to achieve a higher quality profiled extrudant in comparison to larger spoke "widths." Thus, for example, twelve-spoke-wheel designs require a finer tobacco particle grain size than eight-spoke-wheel designs since the width of the spokes in the twelve-spoke design is smaller than in the eight-spoke design.

The aerosol precursor forms an aerosol for delivery to the smoker when the flavor source is subjected to heat. It is a material that, during the mixing process, becomes widely dispersed among and adsorbed by the tobacco particles. Advantageously, absorption by the tobacco and gelling agent minimizes migration or wicking of the aerosol precursor so that it remains widely dispersed. The method and process of introduction depends upon the specific gelling agent chosen for the flavor source. The aerosol precursor also serves as a lubricant to facilitate mixing of the components. The preferred aerosol precursor material is glycerin, preferably U.S.P. grade glycerin, added in a liquid state containing substantially no water. Other aerosol precursor materials may also be used, such as, propylene glycol, 1,3-butanediol and the like.

Optionally, conventional flavoring agents may be added to the flavor source, e.g., menthol, oil of peppermint, tobacco extract, nicotine, and other tobacco flavoring agents known to those of skill in the art. These are typically provided in a liquid carrier solution of water, alcohol or propylene glycol. The carrier liquids tend to be absorbed by the tobacco or the glycerin and so disperse the flavoring agent.

Water is added to the mixture to facilitate the formation of the gel. The method and process of introduction depends upon the specific gelling agent chosen for the flavor source. The preferred type of water is deionized water. The amount added can be varied but the water to glycerin ratio of the mixture must be at least about 25/75 by weight and preferably in the range from about 25/75 to about 75/25 by weight, for the preferred gelling agents, as discussed below. The minimum amount of water that can be used, relative to the amount of aerosol precursor, is limited by the requirement that the final extruded flavor source should have sufficient structural framework so that it is rigid and solidified. Thus, for example, since glycerin is not effective at solidifying the gel-based flavor source (in comparison to water), the minimum water to glycerin ratio is about 25/75 by weight for the preferred gelling agents. With other aerosol precursors or gelling agents this ratio may be smaller.

The gelling agent is any material which upon processing is capable of imparting sufficient structural framework for rigidity while allowing the tobacco, aerosol precursor or other flavor agents to remain dispersed throughout the three-dimensional structural framework. There is no requirement that the tobacco, aerosol precursor or other flavor agents remain in the spaces between the three-dimensional structural units; they can make up part of the structural unit that supplies the necessary rigidity.

The mixture of the gelling agent with the other components make up what is referred to as a colloidal system where the dispersion phase (or dispersing medium) is the gelling agent and the dispersed phase (or colloid) is comprised of tobacco, aerosol precursor and other flavor agents. A colloidal system is defined in this application to mean an intimate mixture of two (or more) substances, one of which is called the dispersed phase (or colloid) which is uniformly distributed in a finely divided state through the second substance, called the dispersion medium (or dispersing medium).

A colloidal system that resembles a solid, because of the sufficient structural framework which imparts rigidity, is referred to in this application as a gel. Other types of colloidal systems are 1) sols (dispersions of solid in liquid), 2) emulsions (dispersion of liquids in liquids), 3) gaseous aerosols (dispersions of liquids or solids in gases), and 4) foams (dispersions of gases in liquids or solids).

Gels have the unique property that since they have a shear modulus of rigidity they are like solids, but in most other physical respects, they behave like liquids. As a result, gels can be solidified and formed into a one-piece flavor source by extrusion through a die. Furthermore, and most importantly, gels are capable of containing up to about 98 percent liquid by weight. This property implies that flavor sources, in which a gelling agent supplies the necessary rigidity to the source can contain larger amounts of aerosol precursor or other liquids, including but not limited to water, than other prior art flavor sources.

These unique properties of gels also aid in controlling the desiccation and pyrolization of the flavor source by presenting a thermal load with high liquid content to the heat source of the smoking article. Thus, the flavor source may be subjected to gas temperatures above the ignition temperature of tobacco, yet the flavor source will not heat up to ignition temperature. The gel also may reduce the ashing tendency of the flavor source as it is pyrolized.

Gelling agents may be selected from, but are not limited to, agar, pectin, gelatin, gellan, and carrageenan. The preferred gelling agents are agar, pectin and gelatin, added in the powder state.

A preferred agar is type AGAR AGAR TIC PRETESTED® 100 FCC POWDER, purchased from TIC Gums, Inc., of Belcamp, Md., which is described as a complex polysaccharide consisting of galactose chains, neutral agarose, pyruvated agarose, and sulphated galactan with an estimated molecular weight of between 5,000 and 30,000 and is advertised to have the following properties: pH of 8, gel point of 103° F., moisture of 20 percent maximum, gel strength of 500 g/cm$^2$ and 10 ppm sulfite.

A preferred pectin is type GENU® Pectin BB Rapid Set 150 Grade USA-SAG, purchased from The Copenhagen Pectin Factory Ltd., in Denmark, a subsidiary of Hercules Inc., of Wilmington, Del. This pectin is described as a high-ester pectin derived from citrus peel and standardized by the addition of sucrose and is advertised to have the following properties: pH of between 3.6–4.4 for a 1% solution in deionized water at 25° C., maximum setting time of 140 seconds, gel strength of 150 plus or minus 5 grade USA-SAG.

A preferred gelatin is type Edible 300 A Gelatin, purchased from Phillip Rockley, Ltd., of New York, N.Y., which is advertised to have the following properties: pH of 5.0 plus or minus 0.5, moisture of 12% maximum, bloom (AOAC) of 300 plus or minus 10 gms and viscosity of 50 plus or minus 5 mps.

The above-listed types of gelling agents and their properties are only listed for example purposes and should not be interpreted to limit the invention disclosed herein in any way.

A sufficient amount of gelling agent is used to permit the mixture of tobacco particles, aerosol precursor, other flavor agents, water, and the gelling agent to be formed into a desired shape. The preferred amount of gelling agent is dependant upon the specific type of agent used, but will range from about 1 to about 5 percent by weight for the preferred gelling agents, as discussed below.

The equipment required in the step of mixing the gelling agent with aerosol precursor and/or water, or the step of mixing the aerosol precursor with water, may be any conventional mixing or blending apparatus, such as Model 91-263, manufactured by Waring, of New Hartford, Conn. Mixing can also be accomplished on a larger scale with any conventional extruder machine and control apparatus, for example, extruders such as those used in the food processing industry. The primary requirement of the mixing apparatus is that it should be able to homogeneously mix the constituents which are placed into it in a reasonable time period.

The heating step that is required during the mixing process, prior to the step of mixing in tobacco particles, can be performed with any conventional heat source. The heat source can be incorporated into the mixing or blending apparatus which is used in the step where the gelling agent is mixed with water and/or aerosol precursor. More preferably, however, the heat source should be a separate apparatus, and preferably a conventional hot plate where the temperature of the plate can be controlled from room temperature up to 500° C.

The equipment for shaping the flavor source may be any conventional extruder or injection molding machine. In the Examples below the machine used was a conventional capillary rheometer barrel, with a two zone temperature controller, model 3501-H, manufactured by Monsanto Research Corp., of Dayton, Ohio, having a 25:1 length to diameter ratio. A conventional extruder machine which can be used is a model MPF-50, manufactured by APV Baker, of Grand Rapids, Mich.

The flavor sources formed by this invention can be extruded through a die into a variety of shapes. These shapes include, but are not limited to, a flat sheet, a star pattern, and four, six, eight or twelve-spoke wheel shapes. Preferably, the shape should be an eight or twelve-spoke wheel design where a plurality of vanes radiate outward from a central cylinder in a spoke-like fashion. The extrusion dies associated with these preferred embodiments are shown in FIGS. 1(*a*) and 2, respectively. FIG. 1(*b*) depicts a perspective view of an eight-spoke wheel flavor source 300 extruded out of the die of FIG. 1(*a*). The outside diameter of the wheel is preferably 0.25 inches so as to form a friction fit inside of the chamber (or flavor bed) in the smoking article. Of course the required dimensions of this diameter will depend upon the dimensions of the chamber (or flavor bed) in the particular smoking article that the flavor source is incorporated into. Furthermore it will depend upon the amount of gel shrinkage that takes place from the time that the gel is extruded until it is inserted into the chamber (or flavor bed) in the smoking article, during which time the gel sets. The size of the extrusion die should be adjusted so as to allow a friction fit of the gel-based source in the smoking article chamber after gel shrinkage has stabilized.

It is desirable to extrude the extrudant out of the die at a substantially uniform flow velocity. This will provide a profiled extrudant material that will have substantially uniform dimensional characteristics, particularly with respect to surface area. The rheology of the mixtures may be adjusted to improve extrudability, as discussed below. A flow velocity of about 0.25 ft/sec. to about 4 ft/sec. is preferred.

After extrusion, the gels are allowed to set for a period of time which depends upon the specific gelling agent used, as discussed below. Preferably, the gels should be allowed to set prior to cutting the extruded gel material (preferably perpendicular to the longitudinal axis) into individual flavor sources, although cutting immediately after extrusion is also possible. The cutting process is preferably performed with a knife. If the gels are cut immediately after extrusion, they could be cut by a knife which is incorporated into the extrusion apparatus. This knife may be placed in close proximity to and preferably in frictional contact with the die orifice of the extrusion machine and rotated to cut the extrudant as it exits the apparatus. The preferred length for incorporation of a eight or twelve spoke wheel shape into the chamber (or flavor bed) of a smoking article is about 10 mm after the gel sets.

The method by which the flavor sources of this invention are produced depends in part on the gelling agent employed.

If agar is used as the gelling agent, then glycerin, water and flavorant are first mixed together, preferably in a blender at medium setting. About 1 to about 3 percent by weight agar is then slowly added to the vortex and blended until the mixture is homogeneous. Since the glycerin and water are pre-mixed, dispersion of the agar throughout the solution is easier to accomplish. This solution should then be removed from the mixing apparatus and then slowly heated to boiling temperature while it is stirred. When the solution begins to boil, it is then removed from the heat source. About 25 to 40 percent by weight tobacco particles by weight should then be immediately added to the mixture while it is continually stirred and allowed to cool down to almost room temperature. Gelation occurs upon cooling.

Since agar gels set immediately upon contact with a cold surface, a two zone temperature controller on a capillary rheometer barrel should be used to form the dough. The top zone should be preferably set at about 115° F. and the bottom exit zone preferably at 100° F. The dough should be loaded into the rheometer barrel and then extruded through the die. It was found that extrudability improves at the higher glycerin and tobacco levels. Extruded agar gels set to a rigid structure in a time period on the order of 30 minutes. It was also found that the set time decreases as the water level increases. Flavor sources formed using agar in the above described process were found to experience shrinkage in the range from about 3 to 15 percent depending upon the initial composition. The amount of shrinkage was larger for flavor sources composed of the higher amounts of water and lower gelling agent contents. Shrinkage was measured as a weight loss.

If pectin is used as the gelling agent, then about 1 to about 3 percent by weight pectin should be slowly added to water in a blender at medium setting. This solution should be blended until the pectin molecules are homogeneously hydrated. Because the pectin must become hydrated, the amount of pectin possible in the final flavor source will be limited by the amount of water used in this first blending step.

The glycerin and flavorant should then be added to the hydrated pectin solution and blended until homogeneously distributed. This solution should then be removed from the blender and then slowly heated to between 85° and 90° C. while taking care not to boil the solution and therefore possibly degrade the pectin. When the solution reaches 85°-90° C., it should be removed from the heat and about 30 to 45 percent by weight tobacco particles should be stirred in while then allowing the mixture to cool to room temperature.

After cooling, which should take approximately one hour, depending upon the volume of dough, the dough should be extruded in a rheometer with no barrel heat applied. It was found that extrudability was better at the higher pectin levels, higher glycerin levels and higher tobacco levels. The extruded rods should then be allowed to equilibrate and set to a rigid gel structure. This setting process should take approximately ten hours at room temperature.

It was found that the set time could be decreased by lowering the solution's pH level below about 3.5 by adding an acid such as malic, phosphoric, tartaric, or preferably, citric acid, in an amount so that the pH level is reduced below 3.5. The acid can be added at any stage during the blending and mixing steps, but most preferably it should be added to the water/gelling agent solution.

Flavor sources formed using pectin as the gelling agent in the above-described process were found to experience shrinkage in the range from about 10 to 25 percent depending upon the initial composition. The amount of shrinkage was larger for flavor sources composed of the higher amounts of water and lower gelling agents contents. Shrinkage was measured as a weight loss.

If gelatin is used as the gelling agent, then the glycerin, water and flavorant are first mixed together in a blender at medium setting. This solution should then be removed from the blender and heated to above 50° C., yet below boiling, while continuously mixing. While maintaining the temperature above 50° C. about 3.5 to 5 percent by weight gelatin should be stirred into the solution. When the gelatin is homogeneously distributed, stirring should continue for approximately a few minutes. At this point, the solution should be removed from the heat and about 25 to 40 percent by weight tobacco particles should be stirred into the mixture until the particles are homogeneously distributed. Since setting occurs while the solution is cooling down to room temperature, the dough should be extruded immediately in a rheometer in the same fashion that agar gels are extruded, as described above (i.e., with a two-zone temperature controller on a capillary rheometer barrel with the temperatures set at 115° F. and 100° F., respectively).

Extruded gelatin gels set to a rigid structure in a time period on the order of 1 hour at room temperature. It was found that the set time decreases as the glycerin level increases. It was also found that the gelation process is thermally reversible when gelatin is used as the gelling agent.

Flavor sources formed using gelatin in the above described process were found to experience shrinkage in the same range as those formed using agar, that is, in the range from about 3 to 15 percent depending upon the initial composition. The amount of shrinkage was larger for flavor sources composed of the higher amounts of water and lower gelling agent contents. Shrinkage was measured as a weight loss.

In accordance with the preferred embodiment of the flavor source, the gel-based flavor source is inserted into a confined location (herein referred to as "chamber" or "flavor bed") in a smoking article. A typical chamber might be, for example, a cylindrical space about 8 to about 14 mm, preferably about 11 mm, long by about 4 to about 8 mm in diameter. The chamber preferably has non-porous walls along its length and is disposed between a heat source, preferably a carbon heat source capable of sustaining combustion, and a mouth-end of a smoking article. The chamber is further provided with apertures at its heat source end and at its mouth end so that radiant and convective heat from the heat source and puff-induced air drawn over the heat source will enter the chamber from the heat source and pass about the flavor source and exit the chamber to the mouth-end. Further, the chamber may comprise a separate flavor bed having nonporous walls that can be filled with a flavor source and closed on each end by retainer clips thereby to form a unit to be included in a smoking article.

When the flavor source is subjected to heat, the aerosol precursor will form an aerosol, and the flavor components of the tobacco and any added flavoring agent will volatize and either condense on the aerosol, form its own aerosol, or form a non-aerosol vapor for delivery to the smoker. Preferably, the temperature will be sufficient to desiccate and, more preferably as explained below, to pyrolyze the flavor source, thereby to release thermally its flavor components and change the flavor source substantially into some degree of char, without igniting or causing combustion of the flavor source, the aerosol, or any of the volatized flavor components.

Referring to FIGS. 3–8, the flavor sources of the present invention may be used in an illustrative smoking article 10 having mouth end 8 and a distal end 4 remote from the mouth end, which consists of active element 11, spacer tube 12, and filter element 13, all overwrapped by magnesium oxide cigarette wrapping paper 14. Active element 11 includes a heat source 20 and chamber (or flavor bed) 21 which contains flavor source 300 and releases a flavored aerosol and non-aerosol vapors when subjected to heat from heat source 20. The aerosol and non-aerosol vapors pass through spacer tube 12 to filter element 13, and thence into the mouth of a smoker.

Heat source 20 is preferably a carbon material, more preferably a substantially pure carbon with some catalysts or burn additives, having a high surface area which may include a multifaceted interior passageway designed to increase the effective surface area of the source and to combust substantially all of the oxygen passing by the heat source. The heat source also may have sharp corners on the facets to increase radiant heat. Correlatively, given sufficient oxygen, carbon heat source 20 will burn to produce mostly carbon dioxide.

Active element 11 includes outer sleeve 22 which is substantially non-combustible, and does not burn during smoking of article 10. Further, flavor source 300 is kept in an oxygen-deprived region of chamber 21, so that the flavor source does not burn even if the aerosol is hot enough to otherwise ignite it, or if it would otherwise ignite as a result of heat radiated from heat source 20 or the heated oxygen-starved gases passing through chamber 21. Consequently, heat from heat source 20 may pyrolyze flavor source 300 over the useful life of the smoking article, beginning with the end of the flavor source closest to the heat source and spreading to the end of the flavor source closest to the mouth end. Thus, the gas driven off by article 10 in the "mainstream 'smoke'" is mostly carbon dioxide. There is substantially no side-stream "smoke" generated when article 10 is smoked.

Turning to the details of the construction of article 10 insofar as they relate to the present invention, active element 11 is housed in a composite sleeve including an outer sleeve 22 and an inner sleeve 23 within outer sleeve 22. Inner sleeve 23 is folded to provide a lip 24 which holds heat source 20 suspended away from the interior wall of outer sleeve 22, leaving an annular space 25. Chamber 21 is bounded by inner sleeve 23 and between lip 24 and heat source 20 on one end, and a retainer clip 26, which holds flavor source 300 in place while allowing the aerosol to pass into spacer tube 12 on the other end with substantially no pressure drop across chamber 21. More preferably, however, since the flavor source 300 can be inserted into chamber 21 under a friction fit, the friction between the flavor source 300 and inner sleeve 23 would enable the flavor source to stay in place without the need for a retainer clip 26.

Spacer tube 12 gives article 10 the length, and thus the appearance, of an ordinary cigarette. The distal end of spacer tube 12 is necked-down at 120, and necked-down portion 120 fits into the mouth end of inner sleeve 23. Wrapper 14 holds active element 11 and spacer tube 12 together. Preferably, cigarette wrapping paper 14 will have sufficient porosity to allow air to be admitted through paper 14 and outer sleeve 22 to support combustion of heat source 20. Alternatively, paper 14 may be perforated, such as by laser perforation, in the region of outer sleeve 22 which surrounds heat source 20.

Preferably, aluminum cap 27, fitted over necked-down portion 120, closes off the mouth end of active element 11, leaving only an orifice 28 for the passage of the hot vapors. Passage through orifice 28 causes the hot vapors to increase their velocity and then expand into spacer tube 12. Expansion of the vapors and gases into the spacer tube causes cooling of the saturated vapors to form a stable aerosol, thereby minimizing condensation on either of mouth-piece segments 29, 200, increasing the delivery of aerosol to the smoker. The degree of expansion, and therefore of cooling, may be controlled by varying the size of orifice 28 and the volume of spacer tube 12.

Mouthpiece element 13 may be a hollow tube or may include a filter segment 29. Mouthpiece element 13 preferably includes two mouthpiece segments 29, 200. Mouthpiece segment 29 is a cellulose acetate filter plug 201 wrapped in plug wrap 202. Segment 200 is a rod of tobacco filler, wrapped in plug wrap 203, which, in addition to further cooling the aerosol and providing some filtration, may impart additional tobacco taste. The tobacco filler in segment 200 is preferably cut at the standard thirty (30) cuts per inch, but may be coarser to minimize filtration. For example, the tobacco filler may be cut at about fifteen (15) cuts per inch. The two segments 29, 200 of mouthpiece element 13 are jointly overwrapped by plug wrap 204, and the entire mouthpiece element 13 is attached to the remainder of article 10 by tipping paper 205.

The air flow in element 11 into flavor bed 21 is through passage 206 in heat source 20. It is desirable that as large as possible a surface area of heat source 20 be in contact with the air flow to maximize the convective heat transfer to flavor bed 21, and also so that combustion is as complete as possible. For that same reason, passage 206 is not a simple cylindrical passage. Rather, it has a many-sided cross-section, such as the eight-pointed star shown in the Figures. In fact, the surface area of passage 206 in the preferred embodiment is greater than the surface area of the outer surface of heat source 20.

Finally, active element 11 is provided with a reflective end cap 15 which clips into outer sleeve 22 but is covered by wrapper 14. Cap 15 has one or more openings 16 which allow air into active element 11. Openings 16 preferably are located at the periphery of cap 15. In the preferred embodiment, there are six equiangularly spaced openings each having a diameter of eighty (80) mils. Cap 15 increases the reflection of radiation back into active element 11, and also keeps heat source 20 from falling out of article 10 if it somehow becomes lose. This is important when it is considered that heat source 20 smolders at a high temperature between puffs, and is even hotter during puffs. Cap 15 also keeps in any ash that may form during burning of heat source 20.

Further details of smoking articles that could use the flavor source of the present invention are shown in U.S. Pat. No. 4,991,606. Other examples of smoking articles that could use the flavor source of the present invention may be found from published European Patent Applications 0 277 355, 0 212 234, and 0 254 848 and U.S. Pat. No. 4,714,082 and co-pending U.S. patent application Ser. No. 115,640, filed Oct. 26, 1987. Furthermore, the flavor source of the present invention could also be used in smoking articles where the heat source is distributed along the length of the smoking article so that the flavor source, which is also distributed along the length, is in close proximity to the heat source. This type of geometry can be accomplished with the present invention by extruding the gel-based material into a flat sheet or into an elongated one-piece shape.

The following specific examples are intended to illustrate various embodiments of the present invention. These embodiments should not be interpreted to limit the invention in any way.

EXAMPLE 1

A mixture of approximately 47 weight percent glycerin, 15 weight percent water, and 1 weight percent alcohol-based flavor agent was blended in a Waring blender at medium setting. 2.5 percent by weight agar was added slowly to the vortex and blended for 10 to 15 seconds. The solution was then transferred to a beaker and stirred while heating on a hot plate. Once the solution was boiling, the solution was removed from the heat and approximately 35 percent by weight tobacco dust was added. A cased tobacco blend which was ground to 120 mesh was used. The dough was continuously stirred by hand and allowed to cool to room temperature over a period of about ten minutes.

Since agar gels set immediately upon contact with a cold surface, the two zone temperature controller on the capillary rheometer barrel was used. The top zone was set to 115° F. and the bottom zone at 100° F. The dough was loaded into the rheometer barrel using a syringe and extruded through several dies to produce rods of various geometries. Dies used include a flat sheet, a star, and 4, 6, 8 and 12 spoke wheels.

The agar gels set to a rigid structure after approximately 30 minutes in a cold room (approximately 40° F.). Analytically, the final Oven Volatiles was approximately 20 percent (as defined, for example, in U.S. Pat. No. 32,013) with a glycerin level of 52 percent (measured by gas chromatography). The rods experienced a shrinkage of about 3 percent by weight.

EXAMPLE 2

Approximately 2.7 percent by weight pectin was slowly added to 50 percent by weight water in a Waring blender. The solution was blended for several minutes to hydrate the pectin molecules. 17 percent by weight glycerin and 1 percent by weight alcohol-based flavor agent were then added to the pectin solution. The solution was transferred to a beaker and slowly heated to between 85° and 90° C., taking care not to boil the solution and possibly degrade the pectin. The solution was then removed from the heat and 30 percent by weight tobacco dust added.

The mixture was allowed to cool over a period of one hour; the dough was extruded in the rheometer as in Example 1 above, except that no barrel heat was used. The extruded rods were allowed to equilibrate in the lab overnight under uncontrolled conditions, and set to rigid structures. Analytically, the Oven Volatiles after setting was approximately 12 percent, and the glycerin level was 23 percent. The rods experienced a shrinkage of 22 percent by weight.

EXAMPLE 3

Equal weights of glycerin and water were premixed and heated to 55° C. Approximately 3.6 percent by weight gelatin was added and stirred for 2 to 3 minutes while maintaining the solution temperature at 55° C. The solution was removed from the heat and 40 percent by weight tobacco dust added.

The dough was extruded immediately in the rheometer, with no heat applied as in Example 2 above. The gels were allowed to set over a period of one hour in a cold room (approximately 40° F.). The gelatin gel characteristics were similar to agar gel characteristics.

One skilled in the art will appreciate that the present invention can be practiced by other than the described embodiments, which are presented for purposes of illustration and not of limitation and the present invention is limited only by the claims which follow.

What is claimed is:

1. A thermally releasable gel-based flavorant source for use in a smoking article wherein the flavorant source comprises a mixture of a gelling agent, as a dispersing medium, and a dispersed phase which supplies flavor to the flavorant source, wherein the dispersed phase comprises a mixture of aerosol precursor, water up to about 50 percent by weight tobacco particles, said tobacco particles having a particle size of up to about 20 mesh, and wherein the water to aerosol precursor ratio by weight is at least about 25/75 and wherein the total amount of water and aerosol precursor contained in the flavorant source is such that upon setting of the mixture a gel is formed.

2. The flavorant source of claim 1 further comprising a gel which after setting is shaped as a one-piece flavorant source.

3. The flavorant source of claim 2 wherein the gel further comprises a central cylinder from which a plurality of vanes radiate outward in a spoke-like fashion.

4. The one-piece flavorant source of claim 2 wherein the aerosol precursor is selected from among the group consisting of glycerin, 1,3-butanediol and propylene glycol.

5. The one-piece flavorant source of claim 2 wherein the gelling agent is selected from among the group consisting of agar, pectin, gelatin, gellan and carrageenan.

6. The one-piece flavorant source of claim 2 wherein the gelling agent is selected from among the group consisting of agar, pectin and gelatin.

7. The one-piece flavorant source of claim 3 wherein the gelling agent is selected from among the group consisting of agar, pectin, gelatin, gellan and carrageenan.

8. The one-piece flavorant source of claim 3 wherein the gelling agent is selected from among the group consisting of agar, pectin and gelatin.

9. The one-piece flavorant source of claim 2 wherein the gelling agent comprises from about 1 to about 3 percent by weight agar.

10. The one-piece flavorant source of claim 2 wherein the gelling agent comprises from about 1 to about 3 percent by weight pectin.

11. The one-piece flavorant source of claim 2 wherein the gelling agent comprises from about 3.5 to about 5 percent by weight gelatin.

12. A flavor generator for use in a smoking article, said smoking article having a heat source and a mouth end, said flavor generator comprising:

a chamber having a first opening and a second opening, the first and second openings being connected by nonporous material so as to create a flow passageway; and a one-piece gel comprising a mixture of a gelling agent, as a dispersing medium, and a dispersed phase which supplies flavor to the source and wherein the dispersed phase comprises a mixture of up to about 50 percent by weight tobacco particles, having a particle size of up to about 20 mesh, an aerosol precursor and water and wherein the water to aerosol precursor ratio by weight is at least about 25/75 and wherein the total amount of water and aerosol precursor contained in the flavorant source is such that upon setting of the mixture a gel is formed.

13. The flavor generator of claim 12 wherein said chamber is substantially cylindrical having a length in a range from about 8 to about 14 mm and a diameter in a range from about 4 to about 8 mm.

14. The flavor generator of claim 12 wherein the means for securing the gel in the flow passageway further provides for fluid flow through the chamber with substantially no pressure drop across the chamber.

15. The flavor generator of claim 12 wherein the gel further comprises a mixture of up to about 50 percent by weight tobacco particles, having a particle size up to about 100 mesh, and wherein the gelling agent is selected from among the group consisting of agar, pectin and gelatin, and wherein the aerosol precursor is glycerin.

16. A method of making a thermally releasable gel-based material for use in a smoking article comprising:

mixing together a gelling agent, as a dispersing medium, and a dispersed phase component which supplies flavor to the material;

extruding the mixture through a die to form a profiled extrudant material; and severing the profiled extrudant material, thereby forming a one-piece flavor source for use in a smoking article.

17. The method of claim 16 wherein dispersed phase component is prepared from a mixture comprising 1) up to about 50 percent by weight tobacco particles, having a particle size of up to about 20 mesh, 2) an aerosol precursor, and 3) water, wherein the water to aerosol precursor ratio by weight is at least about 25/75 and wherein the total amount of water and aerosol precursor contained in the material is such that upon setting of the mixture a gel is formed.

18. The method of claim 17 wherein the aerosol precursor is selected from among the group consisting of glycerin, 1,3-butanediol and propylene glycol.

19. The method of claim 17 wherein the gelling agent is selected from among the group consisting of agar, pectin, gelatin, gellan and carrageenan.

20. The method of claim 17 wherein the gelling agent is selected from among the group consisting of agar, pectin and gelatin.

21. The method of claim 18 wherein the gelling agent is selected from among the group consisting of agar, pectin and gelatin.

22. The method of claim 18 wherein the gelling agent is selected from among the group consisting of agar, pectin, gelatin, gellan and carrageenan.

23. The method of claim 17 wherein the step of extruding the mixture further comprises extruding the mixture through a die having an orifice in the shape of a central cylinder from which a plurality of vanes radiate outward in a spoke-like fashion.

24. The method of claim 17 wherein the step of extruding the mixture further comprises passing the mixture out of the die at a rate of from about 0.25 to about 4 feet per second.

25. The method of claim 17 wherein the gelling agent comprises from about 1 to about 3 percent by weight agar.

26. The method of claim 17 wherein the gelling agent comprises from about 1 to about 3 percent by weight pectin.

27. The method of claim 17 wherein the gelling agent comprises from about 3.5 to about 5 percent by weight gelatin.

28. The method of claim 23 wherein the gelling agent comprises from about 1 to about 3 percent by weight agar.

29. The method of claim 23 wherein the gelling agent comprises from about 1 to about 3 percent by weight pectin.

30. The method of claim 23 wherein the gelling agent comprises from about 3.5 to about 5 percent by weight gelatin.

* * * * *

UNITED STATES PATENT AND TRADEMARK OFFICE

CERTIFICATE OF CORRECTION

PATENT NO. : 5,240,016
DATED : August 31, 1993
INVENTOR(S) : Nichols et al.

It is certified that error appears in the above-indentified patent and that said Letters Patent is hereby corrected as shown below:

Column 3, line 45, "5--5" should be -- 7--7 --.

Column 3, line 47, "6--6" should be -- 8--8 --.

Signed and Sealed this

Third Day of May, 1994

Bruce Lehman

*Attest:*

BRUCE LEHMAN

*Attesting Officer*

*Commissioner of Patents and Trademarks*